US005084919A

United States Patent [19]

Bittel, Sr.

[11] Patent Number: 5,084,919

[45] Date of Patent: Feb. 4, 1992

[54] SWIMMING POOL LADDER GUARD

[76] Inventor: John A. Bittel, Sr., 85 Park Dr. N., Staten Island, N.Y. 10314

[21] Appl. No.: 605,374

[22] Filed: Oct. 30, 1990

[51] Int. Cl.[5] ..... E04H 4/16

[52] U.S. Cl. ..... 4/496; 4/490; 182/106

[58] Field of Search ..... 4/490, 496, 504, 496, 4/661; 15/1.7, 257; 248/303, 304, 210, 211, 231.8; 182/106, 107

[56] References Cited

U.S. PATENT DOCUMENTS

| | | | |
|---|---|---|---|
| 2,251,512 | 8/1941 | Bush et al. | 248/304 |
| 3,108,776 | 10/1963 | Cook | 248/210 |
| 3,973,646 | 8/1976 | Martinez | 182/106 X |
| 4,398,309 | 8/1983 | Simons | 4/661 |
| 4,429,429 | 2/1984 | Altschul | 4/496 |
| 4,856,124 | 8/1989 | McJunkin | 4/496 |
| 4,893,363 | 2/1990 | Huff | 4/496 |
| 4,912,785 | 4/1990 | Inman | 4/496 |
| 4,949,810 | 8/1990 | Dwinnell | 182/214 |
| 4,979,712 | 12/1990 | Rios | 248/304 |

*Primary Examiner*—William A. Cuchlinski, Jr.
*Assistant Examiner*—W. Morris Worth
*Attorney, Agent, or Firm*—N. J. Aquilino

[57] ABSTRACT

An L-shaped swimming pool ladder guard having hooks for attachment to a swimming pool ladder to prevent an automatic pool cleaner from being entangled between the ladder and the pool wall.

3 Claims, 1 Drawing Sheet

FIG. 1
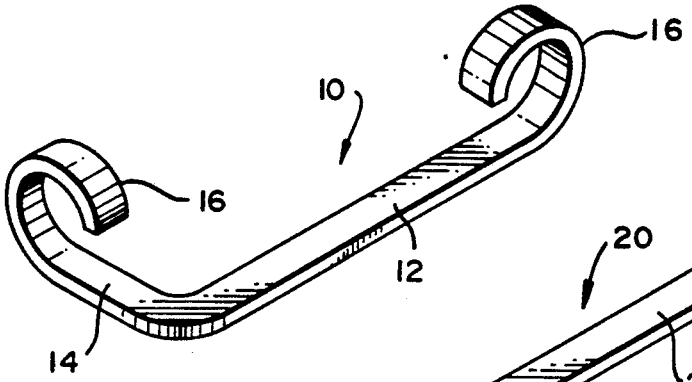
FIG. 2
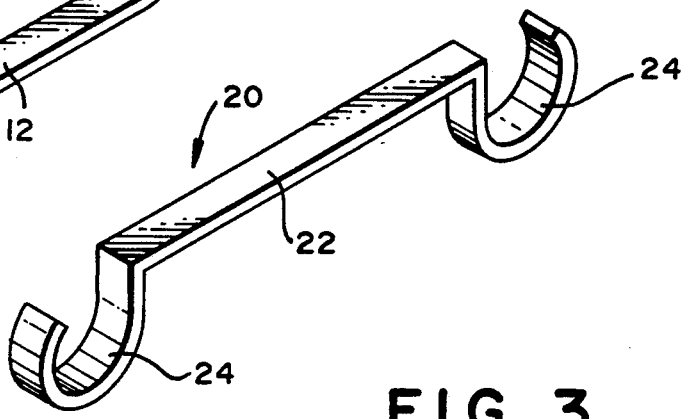
FIG. 3
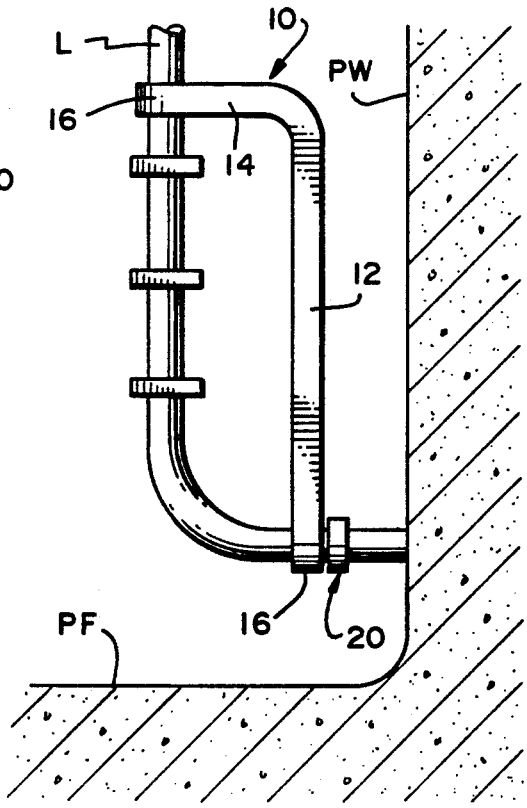
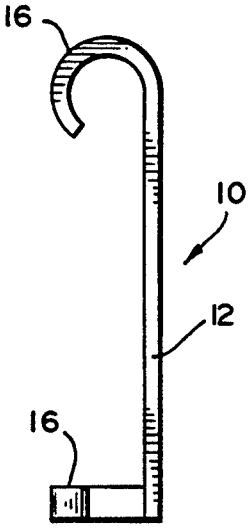
FIG. 4
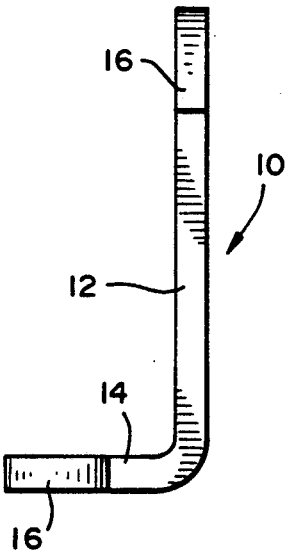
FIG. 5

SWIMMING POOL LADDER GUARD

BACKGROUND OF THE INVENTION

The present invention relates to a swimming pool ladder guard, and in particular to a guard for swimming pool ladders mounted on the walls of a pool to prevent the accidental entanglement of a swimming vacuum unit behind the ladder. Because of the rather tedious task of cleaning pools, various automatic devices have been developed which minimize the amount of work required for cleaning. A number of these devices operate by being self-propelled and advance across the floor and side walls of the swimming pool and clean the pool using either a brushing or vacuum operation. One of the shortcomings in using such devices is that they often become entangled where the wall and/or floor surfaces are discontinuous, such as around steps and ladders.

The general problem has been recognized in the prior art in the patent to Altschul U.S. Pat. No. 4,429,429 which shows the use of a ladder guard in FIGS. 9, 10 and 11, and the patent to McJunkin U.S. Pat. No. 4,856,124 which shows a swimming pool step guard to block the entrance of a pool vacuum or sweeper into the stairwell of a pool.

SUMMARY OF THE INVENTION

The present invention is a ladder guard which attaches to the rails of a swimming pool ladder mounted on the side walls of a pool to prevent an automatic pool vacuum or sweeper from becoming entangled between the rail of the ladder and the pool wall. The ladder guard is made of an elongated semi-rigid strip member having integrally formed hooks on each end which are structured to snap over the ladder tubing and grip it firmly holding the ladder guard in place. The elongated member is formed in two sections, one bent at a right angle to the upper. The hook openings face inwardly as they wrap around the rail creating a smooth outer surface eliminating any obstructions which could catch the cleaner as it abuts or travels past the edge of the ladder. When hooked onto the horizontal and vertical ladder sections, the ladder guard forms an inverted "L" to seal the opening between the ladder and the pool wall.

Among the objects of the present invention are to provide a ladder guard for use with a pool having in wall ladders.

Another object is to provide a pool ladder guard which in inexpensive to manufacture and easy to use and which may be left permanently on the ladder or removed to facilitate cleaning, painting or other maintenance to the pool all surfaces.

DESCRIPTION OF THE DRAWINGS

FIG. 1 is a perspective view of swimming pool ladder guard in accordance with the present invention.

FIG. 2 shows an alternate embodiment of a ladder guard.

FIG. 3 shows a ladder guard in place attached to a swimming pool ladder.

FIG. 4 is a side elevational view of the ladder guard of FIG. 1.

FIG. 5 is a front elevational view of the ladder guard of FIG. 1.

DESCRIPTION OF THE PREFERRED EMBODIMENTS

Referring to the drawings, a ladder guard 10 is preferably made of a transparent, semi-rigid plastic material, such as "Lexan" or the like. The guard 10 is formed as an elongated strip having a first section 12 and a second section 14 bent at 90 degrees to the first and in the same plane thereof in an inverted L-shape. Both the first and second sections include hooks 16 connected to their respective ends which are structured to snap over the ladder tubing and grip it firmly. Preferably, the guard is made of a clear plastic strip approximately one-quarter inch thick by three-quarters to one inch wide. Swimming pool ladders are typically spaced eighteen inches apart and off-set from the wall by seven inches and are made of one and seven-eighths inch outside diameter tubing. The hooks on the end of each section of the guard formed in a semi-circular shape with a diameter slightly less than the one and seven-eighths inch dimension used for the ladder tubing. The natural resiliency of the plastic material permits the hook 16 to be snapped onto the tubing so that the guard 10 may be secured thereon. Both the hooks 16 are bent to extend upwardly from the same side of the strip so that when the guard is snapped onto the ladder a smooth outer surface is presented which acts as a barrier preventing the entrance of a swimming pool sweeper or vacuum from entering the opening between the ladder and the pool wall. The guard 10 need not be removed from the ladder for cleaning since there is enough room between the guard 10 and the pool wall to insert a brush for cleaning purposes. However, the guard 10 may be easily removed by unsnapping the resilient hook 16 to accommodate pool maintenance, such as repainting, repairing the ladder, and so forth.

A second embodiment of a pool guard 20 is shown in FIG. 2 which is structured to provide a barrier between the bottom of the ladder and the pool floor. This embodiment is formed of an elongated rectangular simi-rigid strip member 22 having a resilient hook 24 extending outwardly on each end. This arrangement permits the guard to be snapped directly onto the bottom horizontal members of the ladder blocking the bottom opening between the ladder and the sides of the pool.

Referring to FIG. 3, a ladder guard 10 is shown connected to a swimming pool ladder L using the pair of resilient hooks 16 to resiliently grip the tubular ladder frame. The elongated section 12 is longitudinally positioned between the ladder L and the pool wall PW, thereby blocking the space therebetween. A pool guard 20 is positioned at the bottom of the ladder L to block the opening between the ladder L and the pool floor PF.

It will be appreciated that modifications may be made without departing from the spirit and scope of the invention as defined in the following claims.

I claim:

1. A swimming pool ladder guard for use in a pool with a ladder mounted on, and spaced from, a pool wall to provide a barrier between the ladder and the pool wall comprising:

an elongated, L-shaped, semi-rigid strip member having a first rectangular section with an upper surface in a first plane and a second rectangular section formed at 90° to said first section, and having an upper surface in said first plane thereof;

a first hook member formed in a distal end of said first section, curving upwardly from said distal end and back over said upper surface of said first section; and a second hook member formed on a distal end of said second section, curving upwardly from said distal end and back over said upper surface of said second section;

said hook members being resilient and structured to grip said ladder for mounting said guard thereon.

2. The guard of claim 1 wherein the first section of said L-shaped strip member is substantially longer than the second section.

3. The swimming pool ladder guard system for use in a pool having a wall-mounted ladder to provide a barrier between the ladder and a pool wall comprising:

a first guard member attached to said ladder for forming a barrier between the side of the ladder and the pool wall;

said first guard member formed of an elongated, L-shaped, semi-rigid strip member having a first rectangular section with an upper surface in a first plane, and a second rectangular section connected with said first section and 90° degrees thereto, and having an upper surface in said first plane thereof;

each of said first and second sections having a distal end;

a resilient hook member formed on each distal end of said first and second sections, each hook member curving upwardly from the distal end and back over the upper surface of said first and second section, respectively; said hook members being resilient and structured to grip said ladder for mounting said guard thereon;

a second guard member attachable to a bottom of the ladder to form a barrier between the bottom of the ladder and the pool wall; said second guard member formed of an elongated, rectangular, semi-rigid strip member having ends;

a resilient hook member formed on each end of said second guard member, said hook members opening in the same direction relative to an upper surface of said second guard member; and said hook members on said second guard member being resilient and removably attachable on said ladder for attachment thereto.

* * * * *